US009297109B2

(12) United States Patent
Sartor

(10) Patent No.: US 9,297,109 B2
(45) Date of Patent: Mar. 29, 2016

(54) LAUNDRY DRYER

(71) Applicant: Electrolux Home Products Corporation N.V., Brussels (BE)

(72) Inventor: Luciano Sartor, Conegliano (IT)

(73) Assignee: ELECTROLUX HOME PRODUCTS CORPORATION N.V., Zaventem (BE)

( * ) Notice: Subject to any disclaimer, the term of this patent is extended or adjusted under 35 U.S.C. 154(b) by 122 days.

(21) Appl. No.: 14/175,556

(22) Filed: Feb. 7, 2014

(65) Prior Publication Data

US 2014/0150281 A1 Jun. 5, 2014

Related U.S. Application Data

(63) Continuation of application No. 11/554,609, filed on Oct. 31, 2006, now Pat. No. 8,646,190.

(51) Int. Cl.

| | |
|---|---|
| ***D06F 58/20*** | (2006.01) |
| ***D06F 58/02*** | (2006.01) |
| ***D06F 58/04*** | (2006.01) |

(52) U.S. Cl.

CPC ..... *D06F 58/02* (2013.01); *D06F 58/04* (2013.01)

(58) Field of Classification Search

CPC ..... D06F 58/00; D06F 58/20; F26B 21/00; F26B 21/06; F26B 25/00

USPC ..... 34/601, 606, 610; 68/19, 20; 8/149, 159

See application file for complete search history.

(56) References Cited

U.S. PATENT DOCUMENTS

| | | | | |
|---|---|---|---|---|
| 2,752,695 | A | 7/1956 | McCormick | |
| 2,875,996 | A | 3/1959 | Hullar | |
| 3,436,934 | A * | 4/1969 | Stilwell, Jr. | 68/140 |
| 4,360,977 | A | 11/1982 | Frohbieter | |
| 4,702,018 | A | 10/1987 | Hastings | |
| 4,972,605 | A | 11/1990 | Montalvo | |
| 5,363,569 | A | 11/1994 | Kadakia | |
| 5,711,171 | A * | 1/1998 | Uhlin | 68/4 |
| 5,881,576 | A | 3/1999 | Davies | |
| 6,874,248 | B2 | 4/2005 | Hong et al. | |
| 6,941,679 | B1 | 9/2005 | Harris et al. | |
| 7,976,111 | B2 * | 7/2011 | Sans Rovira et al. | 312/228 |

(Continued)

FOREIGN PATENT DOCUMENTS

| | | |
|---|---|---|
| EP | 0588100 | 3/1994 |
| EP | 19811968 | 9/1999 |

(Continued)

OTHER PUBLICATIONS

European Search Report for EP 05110287, dated Apr. 21, 2006, 2 pages.

*Primary Examiner* — Stephen M Gravini

(74) *Attorney, Agent, or Firm* — Pearne & Gordon LLP

(57) ABSTRACT

The present invention refers to a laundry dryer having a removable front casing panel (1).

A laundry dryer according to the invention comprises a front casing panel (1) and a frame structure (4) for accommodating a tub (5) and operational component parts (6) which are required for drying laundry, said frame structure (4) comprises a front supporting member (12) having means (21) for removably mounting said front casing panel (1). The laundry dryer is characterised in that said front supporting member (12) comprises a portion (13) that forms a component part of said tub (5).

24 Claims, 2 Drawing Sheets

(56) References Cited

U.S. PATENT DOCUMENTS

| | | | | |
|---|---|---|---|---|
| 7,987,616 | B2 * | 8/2011 | Bae et al. | 34/601 |
| 8,256,136 | B2 * | 9/2012 | Bae et al. | 34/407 |
| 8,646,190 | B2 * | 2/2014 | Sartor | 34/603 |
| 8,800,165 | B2 * | 8/2014 | Kwon et al. | 34/595 |
| 9,097,462 | B2 * | 8/2015 | Lorenc et al. | |
| 2004/0010936 | A1 | 1/2004 | Han | |
| 2004/0103556 | A1 | 6/2004 | Bang | |
| 2004/0134093 | A1 | 7/2004 | Han | |
| 2004/0159010 | A1 | 8/2004 | Hwang | |
| 2004/0163275 | A1 | 8/2004 | Hwang | |
| 2005/0268483 | A1 | 12/2005 | Park et al. | |
| 2006/0218817 | A1 | 10/2006 | Lee | |
| 2006/0265899 | A1 | 11/2006 | Renzo | |
| 2007/0006485 | A1 | 1/2007 | Kim | |
| 2007/0094889 | A1 * | 5/2007 | Sartor | 34/601 |
| 2008/0141558 | A1 | 6/2008 | Bae et al. | |
| 2014/0150281 | A1 * | 6/2014 | Sartor | 34/130 |

FOREIGN PATENT DOCUMENTS

| | | | | |
|---|---|---|---|---|
| EP | 1783266 | A1 * | 5/2007 | D06F 58/04 |
| EP | 2204487 | A1 * | 7/2010 | D06F 58/20 |
| EP | 2519682 | | 6/2013 | |
| WO | WO 2006082256 | A1 * | 8/2006 | |

* cited by examiner

LAUNDRY DRYER

The present invention refers to a laundry dryer having a removable front casing panel.

Laundry treating machines of known type generally comprises a cabinet assembly having a base portion, a rear wall, a front wall and a pair of bars extending parallel to the base at the top of the machine between the rear and the front wall. Two lateral panels and a top cover are provided for closing the cabinet. The front wall has not only decorative functions but principally it serves for supporting operational component parts of the machine, such as a laundry treating tub, a control unit and so on.

A drawback of this kind of machines consists in that disassembling the front wall all the operational component parts lose their support and fall down causing cabinet damages. This condition is particularly undesired when a maintenance intervention is needed because the disassembling operations are disadvantageously complicated, especially if the intervention must be performed at home of the user.

From the European Patent No. EP 0 588 100 it is known a laundry treating machine having a frame structure for accommodating operational component parts which are required for the treatment of laundry so as to form a workable and operable basic appliance on which housing panels such as lateral walls, front wall and a top wall can be attached. If the housing panels are removed, such a laundry treating machine can continue working. According to the cited patent a laundry treating machine embodied in a washing machine has a front panel that is practically formed by a decorative cover mounted on a stabilising plate having supporting functions for operational component parts. Even if this solution offers the possibility to select different covers for changing the outside design of the machine, it cannot offers the option to use the same stabilising plate for machines having operational components parts disposed in a different manner. This forces the manufacturer to provide a specific plate for each washing machine model, which is a solution that complicates a lot the manufacturing and assembling processes other than being extremely expensive.

EP 0 588 100 also discloses a laundry dryer wherein the cabinet comprises a frame having a base portion, a rear wall, two front bars, a front reinforcing bar which connects the front bars in the upper region, and lateral reinforcing bars disposed on the left and right in the upper lateral region. In this case the frame has no front stabilising plate but only two front bars and therefore the whole frame can result to be structurally too weak for support efficiently the vibrations and forces produced when the dryer works.

The aim of the present invention is therefore to solve the noted problems, eliminating the drawbacks of the cited known art and thus providing a laundry dryer having a portion of an operational component part that is also part of the machine supporting frame.

Another purpose of the present invention is to provide a laundry dryer in which the front panel can be easily changed with another one of different design.

Still another purpose of the invention is to provide a laundry dryer having a supporting frame of improved stiffness and having a reduced number of components. The same frame being lighter than the supporting frame of known type.

A further purpose of the present invention is to provide a laundry dryer that simplifies the manufacturing and assembling processes.

Advantages, objects, and features of the invention will be set forth in part in the description which follows and in part will become apparent to those having ordinary skill in the art upon examination of the following or may be learned from practice of the invention. The objects and advantages of the invention may be realised and attained as particularly pointed out in the appended claims.

The accompanying drawings, which are included to provide a further understanding of the invention and are incorporated in and constitute a part of this specification, illustrate a possible embodiment of the invention and together with the description serve to explain the principles of the invention.

Figure 1:
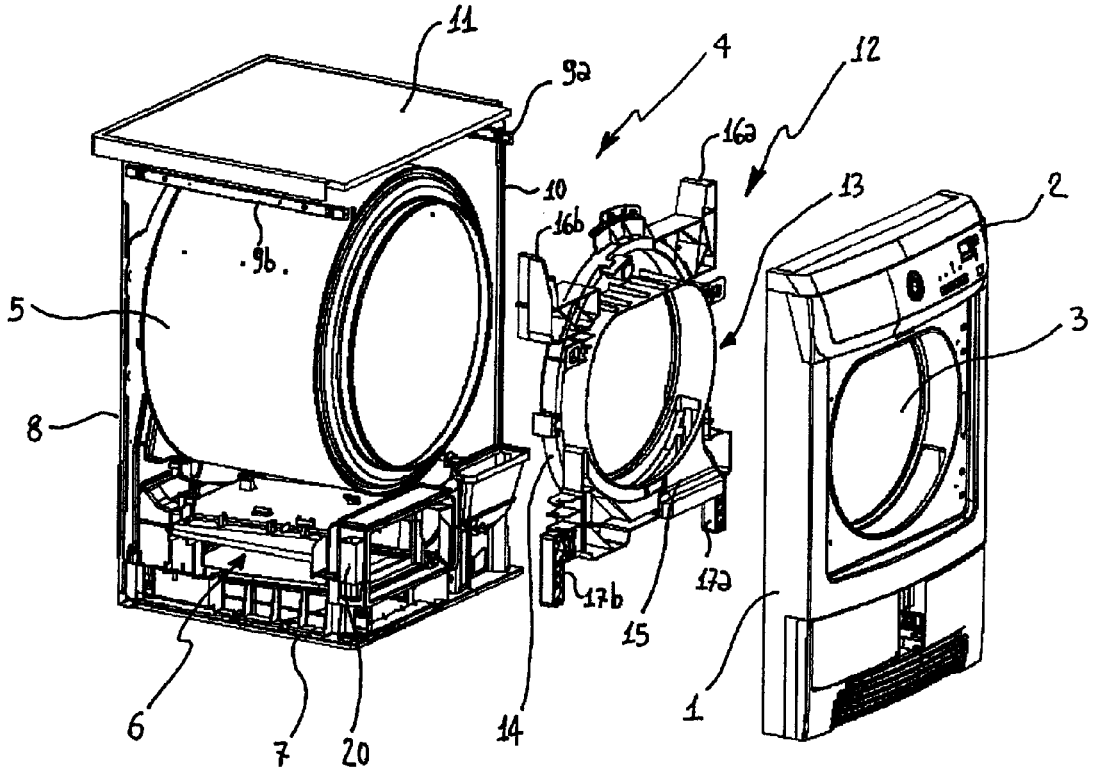
FIG. 1 shows a perspective view of a partly disassembled laundry dryer according to the present invention.

Referring to FIG. 1 the laundry dryer according to the invention comprises a front casing panel 1 on which it is provided a control unit 2 allowing the user to operate the dryer. An opening 3 is provided on the panel 1 for introducing laundry to be dried in the dryer. A frame structure 4 is provided for accommodating a tub 5, containing a drum rotating about a horizontal axis, and operational component parts 6 which are required for drying laundry such as air circulating means, heating means, filtering means, motor means, air conduits, liquid draining means and so on.

The frame structure 4 preferably comprises a base portion 7 and a rear wall 8 associated to the base 7 so as to form an L-shaped assembly. The frame 4 further comprises a pair of lateral bars 9*a*, 9*b* disposed on a upper region of the rear wall 8 and extending substantially parallel to the base 7. The frame structure 4 is provided with means of known type suitable for removably securing casing panels 10, 11 on it so as to form the outer casing of the dryer. Said means can be, for example, snap connectors or through-joints. A pair of opposite lateral casing panels 10 (in FIG. 1 only one of these panels is shown) is mounted so as to join a lateral bar 9*a*, 9*b*, the rear wall 8, and the base 7 thereby forming two lateral sides of a dryer casing. A cover top 11 is removably mounted on the two bars 9*a*, 9*b*.

According to the invention, the frame structure 4 comprises a front supporting member 12 having a portion 13 that acts not only as supporting structure for the tub 5 and for the other operational components parts 6 of the dryer like air conduits, but it forms also an operative part of the tub 5 itself. In particular, said portion 13 comprises an annular element 14 adapted to be attached to the tub 5 so as to form a mouthpiece through which laundry to be dried can be introduced within the tub. The annular portion 14 is further provided with air conveying means 15 for guiding air from or to the tub 5 according to the direction of the air flow imposed by the air circulating means.

Figure 2:
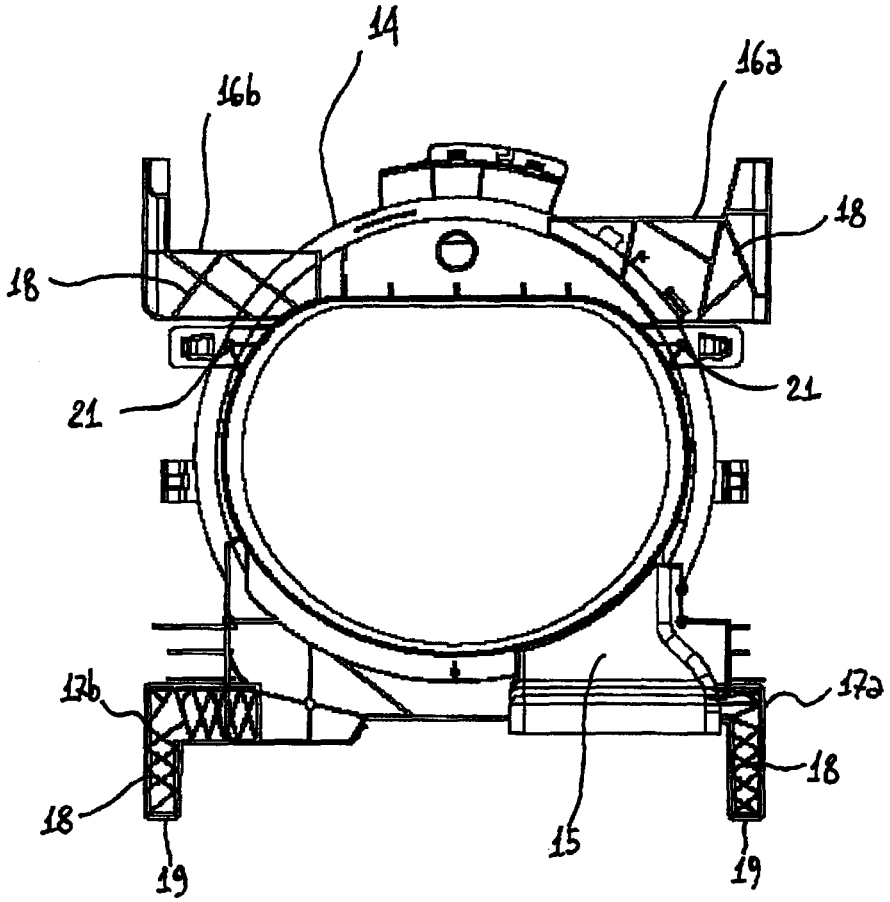
FIG. 2 shows a front view of the front supporting member comprising a component part of the dryer tub.

The annular element 14 is associated to the lateral bars 9*a* and 9*b* and to the base portion 7, i.e. to the other components of the frame structure 4, by means of connecting members 16*a*, 16*b*, 17*a* and 17*b*. With reference to FIG. 2, these members are in the form of four L-shaped connectors having stiffening walls 18. The lower members 17*a* and 17*b*, have a male portion 19 that is received in a corresponding seat 20 formed on the base 7. The upper members 16*a*, 16*b* can be connected to the bars 9*a*, 9*b* by means of screws of other fastening means of known type.

Connecting members 16*a*, 16*b*, 17*a*, 17*b* can be made in a single piece with the annular element 14 in order to reduce the overall number of pieces needed to form the front supporting member 12. Another possible arrangement of the members 16*a*, 16*b*, 17*a*, 17*b* consists in grouping the upper members 16*a*, 16*b* in a first item and the lower members 17*a*, 17*b* in a second item. These items or the single connecting member

16*a*, 16*b*, 17*a*, 17*b* can be joined to the annular element 14 by means of any known kind of fastening means such as screws or through-joints.

The front supporting member 12 has means 21 for removably receiving the front casing panel 1 such that the same member 12 can be used in combination with different types of panels 1 thereby giving the possibility to the dryer manufacturer to change the machine design in a simplified and economic way. In FIG. 2 said means 21 are in the form of cavities in which a screw or a pin member can be removably received; however other known means can be used for connecting the front support member 12 to the front casing panel 1. When the front panel 1 is mounted on the front supporting member 12 the aperture 3 couples with the annular element 14. A door (not shown in FIG. 1) for closing the aperture 3 can be pivotally attached to the panel 1. The control unit 2 carrying input means for operating the dryer can be made as a separate piece to be mounted on the panel 1 or, as an alternative, it can also be made in a single piece with the panel 1 itself. In the latter case component assembling errors and difficulties in connecting the panel 1 with the control unit 2 during the assembling operations will be advantageously avoided.

Advantageously, in order to simplifying the laundry dryer manufacturing process and the weight of the appliance, the front supporting member 12 can be made, at least partly, of plastic material.

Conclusively it can be stated that the laundry dryer according to the present invention allows the integration of an operative component part of a tub with a structural and supporting portion of the appliance cabinet. The same laundry dyer is highly versatile because allows the sharing of components among different models of drying machines.

What is claimed is:

1. A laundry dryer comprising:

a frame structure (4) for accommodating a drum and operational component parts (6) which are required for drying laundry, said frame structure (4) comprising a front supporting member (12) having means (21) for removably mounting a front casing panel (1), wherein said front supporting member (12) comprises connecting members (17*a*, 17*b*) integrally formed therewith to associate the front supporting member (12) to a base portion (7) of said frame structure (4), and wherein said front supporting member (12) comprises a portion (13) that includes an annular element (14) connected to the drum so as to form a mouthpiece through which laundry to be dried can be introduced, said annular element (14) comprising air conveying means (15) guiding air from or to said drum.

2. A laundry dryer according to claim 1, wherein said portion (13) forms a component part of the drum.

3. A laundry dryer according to claim 2, wherein the air conveying means (15) is a single piece with the annular element (14).

4. A laundry dryer according to claim 1, wherein the frame structure (4) comprises a rear wall (8) associated to the base portion (7), thereby forming an L-shaped assembly.

5. A laundry dryer according to claim 4, wherein said frame structure (4) further comprises lateral bars (9*a*, 9*b*) disposed on an upper region of said rear wall (8).

6. A laundry dryer according to claim 5, wherein said front supporting member (12) comprises further connecting members (16*a*, 16*b*) associating the front supporting member (12) to said bars (9*a*, 9*b*).

7. A laundry dryer according to claim 1, wherein said frame structure (12) comprises means for removably mounting casing panels forming an outer casing of said dryer.

8. A laundry dryer according to claim 1, further comprising a control unit (2) configured to operate the dryer.

9. A laundry dryer according to claim 8, wherein said control unit (2) and said front casing panel (1) are made in a single piece.

10. A laundry dryer according to claim 8, wherein said control unit (2) is a separate piece mounted on the front casing panel (1).

11. A laundry dryer according to claim 1, wherein said front supporting member (12) comprises a plastic material.

12. A laundry dryer according to claim 1, wherein said front casing panel (1) comprises an opening (3) configured to provide access to said drum when the front casing panel (1) is mounted on said front supporting member (12).

13. A laundry dryer according to claim 12, wherein the front casing panel (1) comprises mounts for pivotally attaching a door for closing the opening (3).

14. A laundry dryer comprising:

a frame structure (4) for accommodating a drum and operational component parts (6) which are required for drying laundry, said frame structure (4) comprising a front supporting member (12) having means (21) for removably mounting a front casing panel (1), wherein the front supporting member (12) comprises a plurality of connecting members (17*a*, 17*b*) associating the front supporting member (12) to a base portion (7) of the frame structure (4), wherein each connecting member (17*a*, 17*b*) has a male portion (19) that extends from a portion of the front supporting member (12) and is received in a corresponding seat (20) formed on the base portion (7).

15. A laundry dryer comprising:

a drum;

operational component parts (6) which are required for drying laundry; and a frame structure (4) accommodating the drum and operational component parts (6), said frame structure (4) comprising a base portion (7) and a front supporting member (12); and a front casing panel (1) removably mounted to the frame structure (4)

wherein said front supporting member (12) comprises a first connecting member (17*a*) and a second connecting member (17*b*) connecting the front supporting member (12) to the base portion (7), and wherein the front supporting member (12) comprises an annular element (14) connected to the drum, said annular element (14) being provided with air conveying means (15) for guiding air from or to said drum.

16. A laundry dryer according to claim 15, wherein the air conveying means (15) is a single piece with the annular element (14).

17. A laundry dryer according to claim 15, wherein the front casing panel (1) is supported by the front supporting member (12).

18. A laundry dryer according to claim 15, wherein said front supporting member (12) comprises means (21) for removably mounting the front casing panel (1).

19. A laundry dryer according to claim 15, wherein the first connecting member (17*a*) and the second connecting member (17*b*) each comprise a male portion (19) that is received within a corresponding seat (20) formed on the base portion (7).

20. A laundry dryer according to claim 15, wherein the frame structure (4) comprises a rear wall (8) connected to the base portion (7), thereby forming an L-shaped assembly.

21. A laundry dryer according to claim 20, wherein said frame structure (4) further comprises lateral bars (9*a*, 9*b*) disposed on a upper region of said rear wall (8) and extending substantially parallel to said base portion (7).

22. A laundry dryer according to claim 21, wherein said front supporting member (12) comprises a third connecting member (16*a*) and a fourth connecting member (16*b*) connecting the front supporting member (12) to said bars (9*a*, 9*b*).

23. A laundry dryer according to claim 20, wherein said front supporting member (12) comprises a portion (13) that forms a component part of the drum.

24. A laundry dryer according to claim 23, wherein said frame structure (4) further comprises a ceiling portion extending substantially parallel to said base portion (7), the rear wall (8) connecting said base portion (7) and said ceiling portion, further wherein said front supporting member (12) comprises a third connecting member (16*a*) and a fourth connecting member (16*b*) connecting the front supporting member (12) to the ceiling portion such that the front supporting member (12) connects the base portion (7) to the ceiling portion.

* * * * *